US008109779B2

(12) United States Patent
Wu et al.

(10) Patent No.: US 8,109,779 B2
(45) Date of Patent: Feb. 7, 2012

(54) CABLE ASSEMBLY WITH LATCHING MEMBER

(75) Inventors: Jerry Wu, Irvine, CA (US); Chang-Mao Li, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/835,674

(22) Filed: Jul. 13, 2010

(65) Prior Publication Data

US 2011/0008990 A1 Jan. 13, 2011

(30) Foreign Application Priority Data

Jul. 13, 2009 (CN) ..... 2009 2 0306045

(51) Int. Cl.
*H01R 13/627* (2006.01)

(52) U.S. Cl. ..... 439/353

(58) Field of Classification Search ..... 439/353, 439/357, 358, 359, 660, 701
See application file for complete search history.

(56) References Cited

U.S. PATENT DOCUMENTS

| | | | | |
|---|---|---|---|---|
| 7,258,565 | B2 * | 8/2007 | Huang et al. | 439/353 |
| 7,909,632 | B2 * | 3/2011 | Wu | 439/353 |
| 2006/0228935 | A1 * | 10/2006 | Wen et al. | 439/497 |
| 2011/0104931 | A1 * | 5/2011 | Wu | 439/358 |

FOREIGN PATENT DOCUMENTS

CN 200420022197 9/2005

* cited by examiner

*Primary Examiner* — Phuong Dinh
(74) *Attorney, Agent, or Firm* — Wei Te Chung; Andrew C. Cheng; Ming Chieh Chang

(57) ABSTRACT

An cable assembly includes an insulative housing having a main portion and a mounting arm extending rearwardly from the main portion, the mounting arm; a plurality of terminals; a cable having a plurality of wires connected to the plurality of terminals, respectively; a latching member including a connecting arm, a latching arm and a retention arm, the retention arm inserted into a positioning hole in the mounting arm, the connecting arm deflected outwardly; and an external cover enclosing the insulative housing and the latching member, the external cover having a deformable button for actuating the latching arm.

20 Claims, 6 Drawing Sheets

CABLE ASSEMBLY WITH LATCHING MEMBER

FIELD OF THE INVENTION

The present invention generally relates to a cable assembly, and more particularly to a cable assembly with a latching member.

DESCRIPTION OF PRIOR ART

Nowadays, an electrical device has become lower profile and multi-functional, and a cable assembly for the electrical device is also capable of high-speed transmitting, and reliably connection and easily detachable with its counterpart.

CN patent No. 200420022197 issued to Peng on Sep. 7, 2005 discloses a cable assembly. The cable assembly includes an insulative housing, a plurality of terminals accommodated in the insulative housing, a metallic shell enclosing the insulative housing, two locking members mounted to two sides of the insulative housing and two clamping members adapted for securing the two locking members, an external cover and a cable. Each locking member has a mounting portion fixed to the insulative housing, a deformable arm connected to the mounting portion and deflected along up-to-down direction, in addition, a hook is formed at a front end of the deformable arm, and an upward protrusion is formed on the deformable arm and accessible by a deformable button which is formed on the external cover. However, partial of the locking member disposed behind the insulative housing may interferes with wires inside the cable, thus it is inconvenient in assembling process. On the other hand, following the spirit of the inventor's earlier invention, i.e, U.S. Pat. No. 7,651,379, a compact arrangement of new interface connector is desired for applying to a cable assembly.

Hence, an improved cable assembly is highly desired to overcome the aforementioned problems.

SUMMARY OF THE INVENTION

Accordingly, an object of the present invention is to provide a lower profile and easily manufactured cable assembly.

In order to achieve the object set forth, a cable assembly in accordance with the present invention comprises an insulative housing having a main portion and at least one mounting arm extending rearwardly from the main portion, the at least one mounting arm defining a positioning hole; a plurality of terminals received in the insulative housing; a cable having a plurality of wires connected to the plurality of terminals, respectively; at least one latching member including a connecting arm, a latching arm and a retention arm, the latching arm and the retention arm spaced apart from each other and extend forwardly from the connecting arm, the retention arm inserted into the positioning hole in the at least one mounting arm, the connecting arm deflected outwardly; and an external cover enclosing the insulative housing and the latching member, the external cover having a deformable button for actuating the latching arm.

Other objects, advantages and novel features of the invention will become more apparent from the following detailed description when taken in conjunction with the accompanying drawings.

DETAILED DESCRIPTION OF PREFERRED EMBODIMENTS

Figure 1:
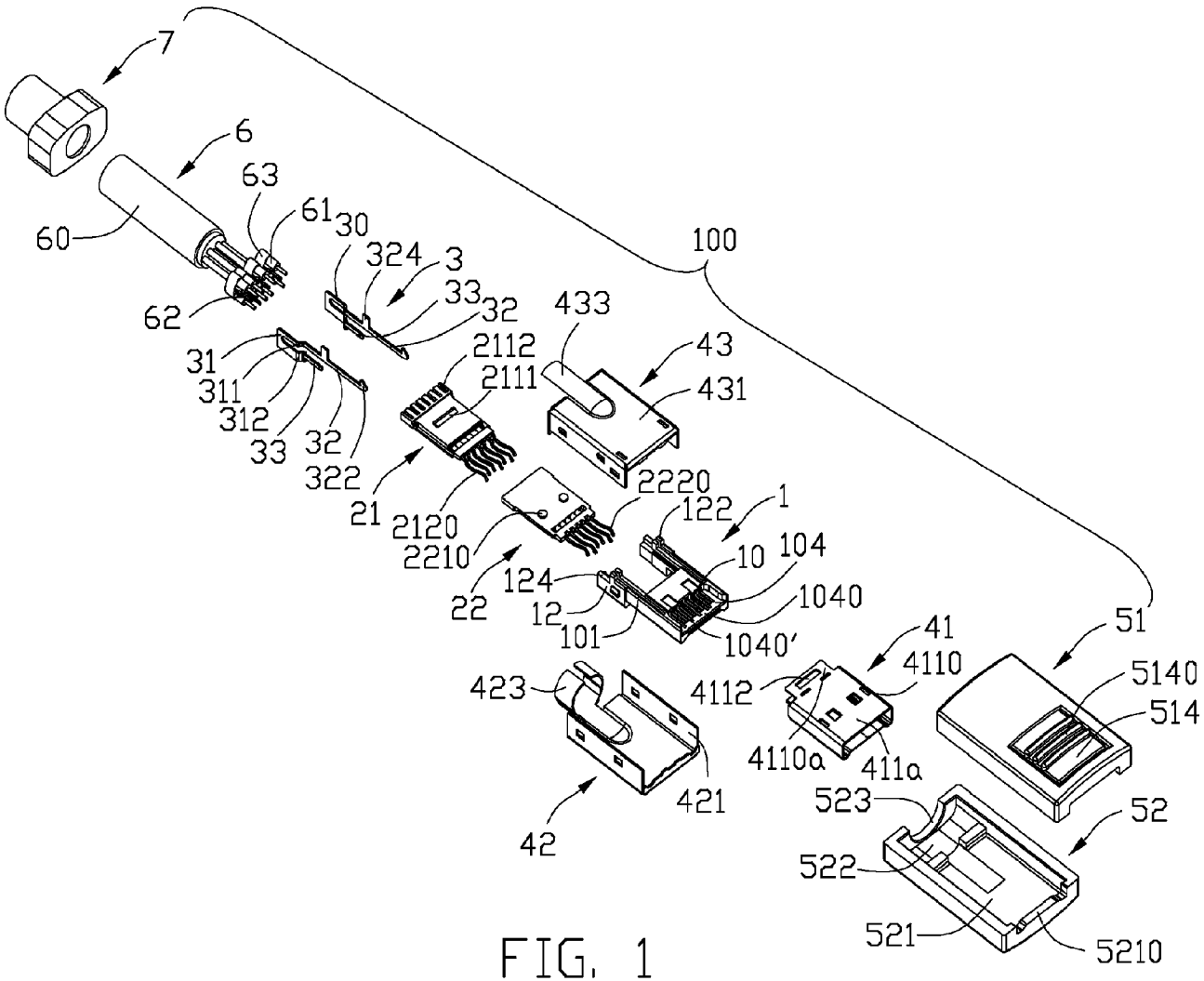
FIG. 1 is an exploded, perspective view of a cable assembly in accordance with the present invention.

Reference will now be made in detail to the preferred embodiment of the present invention.

Referring to FIGS. 1-6, a cable assembly 100 in accordance with the present invention comprises an insulative housing 1, a terminal module 2, two latching members 3, a metallic shell 4, an external cover 5, a cable 6 and a strain relief 7.

The insulative housing 1 includes a main portion 10 and two mounting arms 12 extending rearwardly from lateral sides of the main portion 10. A receiving space 102 is recessed forwardly from a middle segment of a rear edge of the main portion 10. A mating port or cavity 104 is recessed downwardly from a front segment of a top side of the main portion 10 and further communicates with the receiving space 102. The mating port or cavity 104 has a mating face 1040 facing upwardly and a plurality of grooves 1040' formed in the mating face 1040 in one row along a transverse direction. A depression 104' is defined in a lower side of the main portion 10, and the depression 104' is of isosceles trapezoid shape, which has a horizontal side 1041' and two oblique sides 1041', 1042'. A slot 101 is defined in the mounting arm 12 and partial of main portion 10 in front of the mounting arm 12. A positioning hole 126 is defined in a rear portion 124 of the mounting arm 12, and a standoff 122 is formed on middle portion of the mounting arm 12 and projected upwardly.

The terminal module 2 includes a first terminal module 21 and a second terminal module 22. The first terminal module 21 has an insulator (first insulator) 211 and a number of terminals (first contacts) 212 combined together by insert-molding process. The terminals (first contacts) 212 are divided into signal terminals (first signal contacts) and grounding terminals (first grounding contacts) configured to be longer than the signal terminals. The terminals 212 have contacting portions (first front contacting sections) 2120 disposed in front of an edge of the insulator 211 and tail portions (first rear soldering sections) 2122 which are accommodated in terminal slots 2112 defined in a back segment of the insulator 211. Each contacting portion (first contacting section) 2120 of either the first signal contact or the first grounding contacts has a first contacting apexes. Two mounting holes 2110 are defined in a bottom side of the insulator 211 and a protruding portion 2111 are formed on a top side of the insulator 211.

The second terminal module 22 has an insulator (second insulator) 221 and a number of terminals (second contacts) 222 combined together by insert-molding process. The terminals (second contacts) 222 are divided into signal terminals (second signal contacts) and grounding terminals (second grounding contacts) configured to be longer than the signal terminals. The terminals (second contacts) 222 have contacting portions (second front contacting sections) 2220 disposed in front of an edge of the insulator 221 and tail portions (second rear soldering sections) 2222 which are accommodated in terminal slots 2212 defined in a back segment of the insulator 221. Each contacting portion (second contacting section) 2220 of either the second signal contact or the second grounding contacts has a second contacting apexes. Two mounting posts 2210 are formed on a top side of the insulator 221. There are two protruding portions 2214 formed on a bottom side of the insulator 221.

The first terminal module 21 and the second terminal module 22 are assembled together, with the contacting portions 2120, 2220 merged into one row, while the tail portions 2122, 2222 separated into two distinct rows along an up-to-down direction. The first insulator 211 and the second insulator 221 are essentially located at different levels defining two different rows in said transverse direction. The first contacting apexes of the first front contacting sections 2120 and the second contacting apexes of the second front contacting sections 2220 are both exposed above the mating face 1040. The first front contacting sections 2120 of the first contacts 212 and the second front contacting sections 2220 of the second contacts 222 are mixed up with each other in said one row along said transverse direction under condition that both the first contacting apexes of the first signal contacts and the second contacting apexes of the second signal contacts are located at essentially a same first position in a front-to-back direction perpendicular to said transverse direction, and both the first contacting apexes of the first grounding contacts and the second contacting apexes of the second grounding contacts are located, in said front-to-back direction, a same second position in front said same first position. The mounting posts 2210 are inserted into the mounting holes 2110 so as to keep the first terminal module 21 and the second terminal module 22 together. The first terminal module 21 and the second terminal module 22 are assembled to the insulative housing 1, with front segments of the insulators 211, 221 inserted into the receiving space 102.

Each latching member 3 includes a connecting arm 30, a latching arm 32 and a retention arm 33. The latching arm 32 and the retention arm 33 are spaced apart from each other and extend forwardly from the connecting arm 30. The latching arm 32 and the retention arm 33 are located in a vertical plane. The connecting arm 30 has a U-shaped body portion 31 and a first bridge portion 311 and a second bridge portion 312 formed with front ends of the body portion 31. The first bridge portion 311 and the second bridge portion 312 are inwardly deflected and extend forwardly to engage with the latching arm 32 and the retention arm 33, respectively. Therefore the U-shaped body portion 31 is disposed in other vertical plane and parallel to the latching arm 32 and the retention arm 33. A tab 324 is formed on a top side of the latching arm 32 and proximate the first bridge portion 311. The retention arm 33 is inserted into the positioning hole 126 of the mounting arm 12, and the latching arm 32 is received in the slot 101 of the insulative housing 1. The connecting arm 30 is located behind the mounting arm 12 and adjacent to an outer surface of the mounting arm 12, therefore, more space is left inside the connecting arm 30.

The metallic shell 4 has a first shell 41, a second shell 42 and a third shell 43. The first shell 41 includes a frame 411 to accommodate the main portion 10 therein. Two through holes 4110 are defined in a front segment of a top side 411 a of the frame 411 to allow hooks 322 of the latching arm 32 passing through. A first engaging portion 4110*a* projects backward from the top side 411*a*. There is a positioning hole 4112 defined in the first engaging portion 4110*a* to latch with the protruding portion 2111 of the first terminal module 21. The frame 411 has a bottom side 411*b* suitably matching with the depression 104' of the insulative housing 1. A second engaging portion 4110*b* projects backward from the bottom side 411*b*. There is two positioning hole 4114 defined in the second engaging portion 4110*b* to latch with the protruding portions 2214 of the second terminal module 22.

The second shell 42 includes a U-shaped main body 421 and a cable holder 423 integrated with the main body 421 and projecting backwardly. The third shell 43 includes an inverted U-shaped main portion 431 and a tail 433 extending rearward. The second shell 42 and the third shell 43 can be combined together along a vertical direction.

The external cover 5 includes an upper cover 51 and a bottom cover 52. The upper cover 51 has a first hollow 511 and a second hollow 512 disposed behind the first hollow 511. A rectangular shaped opening 5110 is located in the front portion of the upper cover 51, and the opening 5110 further communicates with the first hollow 511. A semicircular shaped outlet 513 is defined in the rear portion of the upper cover 51 and communicated with the second hollow 512. A deformable button 514 is integrally formed with the upper cover 51 and floatable along up-to-down direction to enter the first hollow 511 so as to actuate the tab 324 of the latching arm 32. In addition, a number of ribs 5140 are formed on a top side of the deformable button 514 to increase friction between user's thumb and the deformable button 514.

The bottom cover 52 is similar to the upper cover 51, and also has a first hollow 521 and a second hollow 522 disposed behind the first hollow 521. An opening 5210 is located in the front portion of the bottom cover 52, and the opening 5210 further communicates with the first hollow 521. A semicircular shaped outlet 523 is defined in the rear portion of the bottom cover 52 and communicated with the second hollow 522.

The cable 6 includes a number of wire groups enclosed in a jacket 60. Each wire group includes a pair of signal wires 61 and a grounding wire 62 disposed aside the pair of wires 61, and a shielding member 63 shrouding the pair of wires 61. The shielding member 63 is aluminum foil or other similar structure. The strain relief member 7 is molded over a front segment of the cable 6.

The signal wires 61 and the grounding wires 62 are put into terminal slots 2112, 2222 of the insulators 211, 221 and soldered to the tails 2122, 2222 of the terminals 212, 222. In addition, some of the terminal slots 2112, 2222 for receiving the signal wires 61 are larger than those terminal slots 2112, 2222 for receiving the grounding wires 62, to avoid misconnection problem between the terminals 212, 222 and the signal wires 61 and the grounding wires 62. The strain relief member 7 is accommodated in the second hollows 512, 522.

The two latching members 3 are transversally spaced apart from each other. As the two connecting arms 30 are transversally deflected outwardly, therefore, a distance (space) between the two connection arms 30 enlarges and there is no interfering problem between the cable 6 and the latching member 3.

Figure 2:
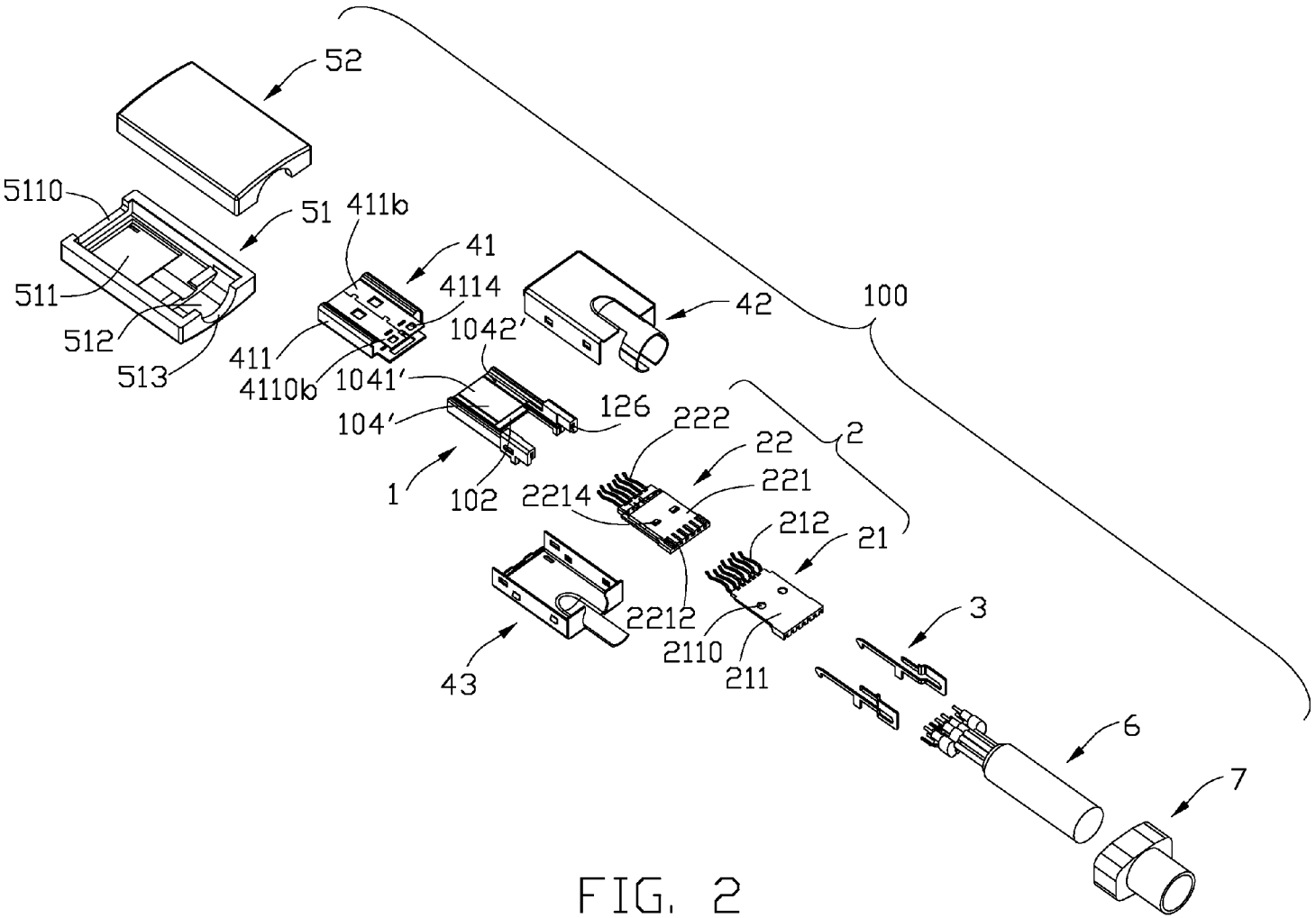
FIG. 2 is similar to FIG. 1, but viewed from another aspect.
Figure 3:
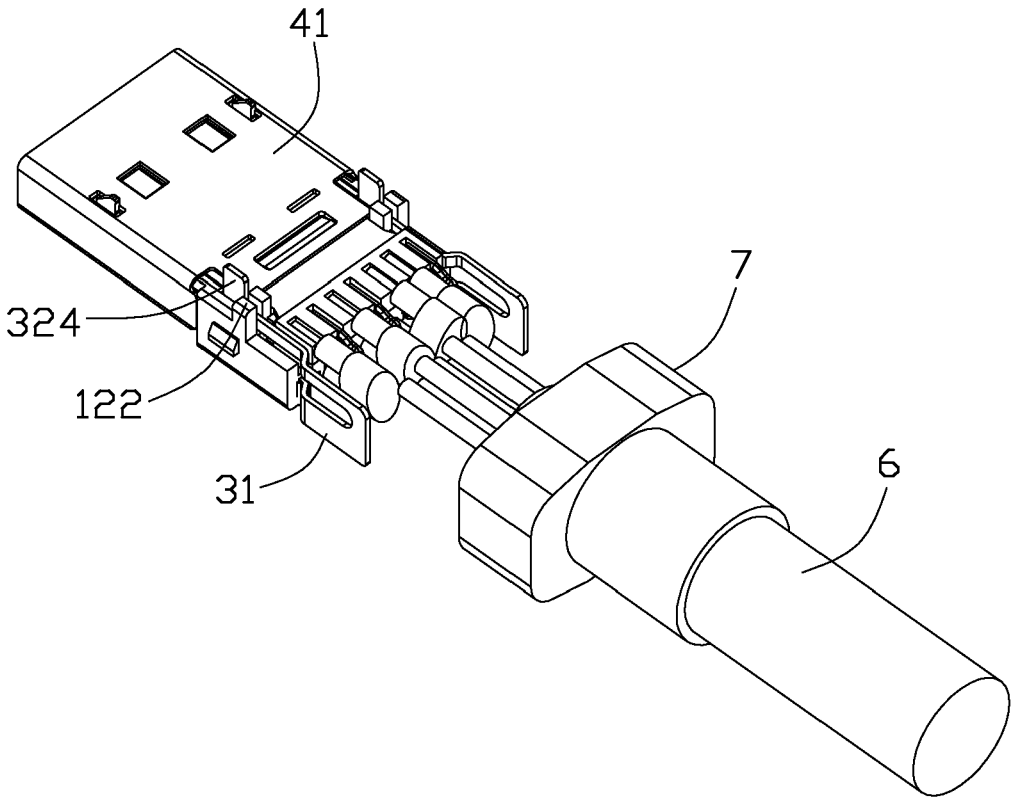
FIG. 3 is a partially assembled view of the cable assembly.
Figure 4:
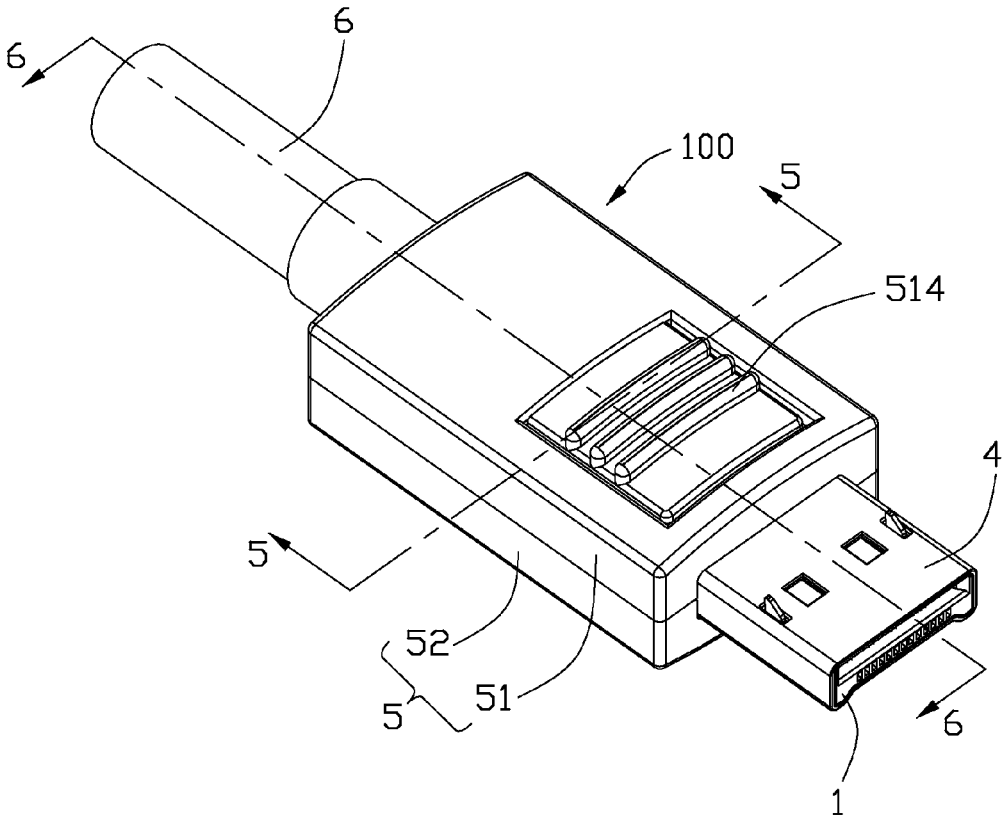
FIG. 4 is an assembled, perspective view of the cable assembly.
Figure 5:
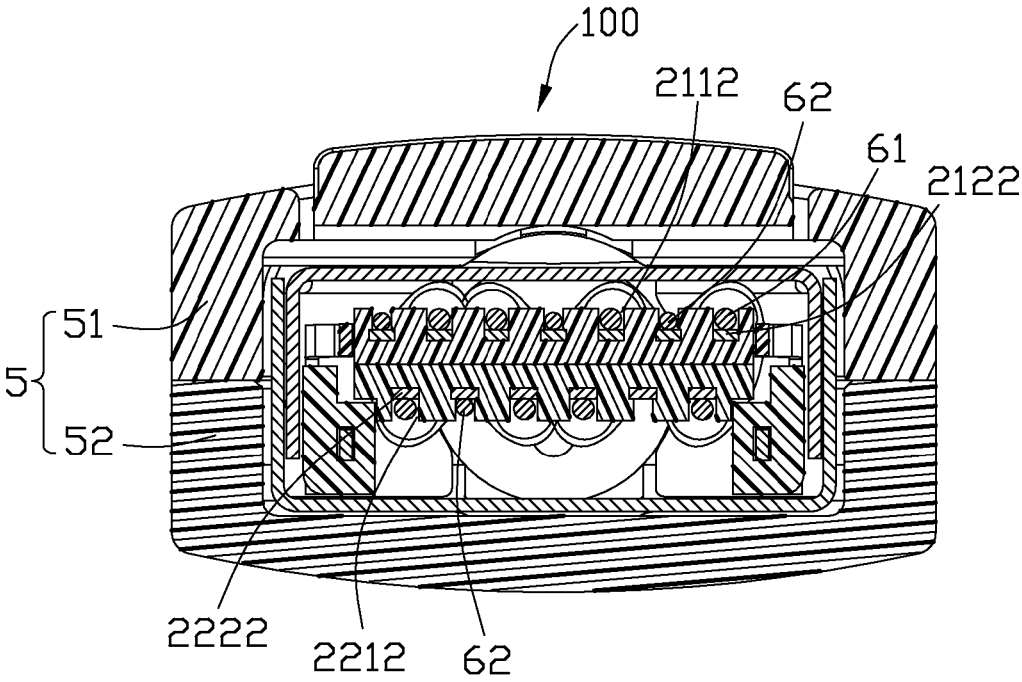
FIG. 5 is a cross-section view taken along line 5-5 of FIG. 4.
Figure 6:
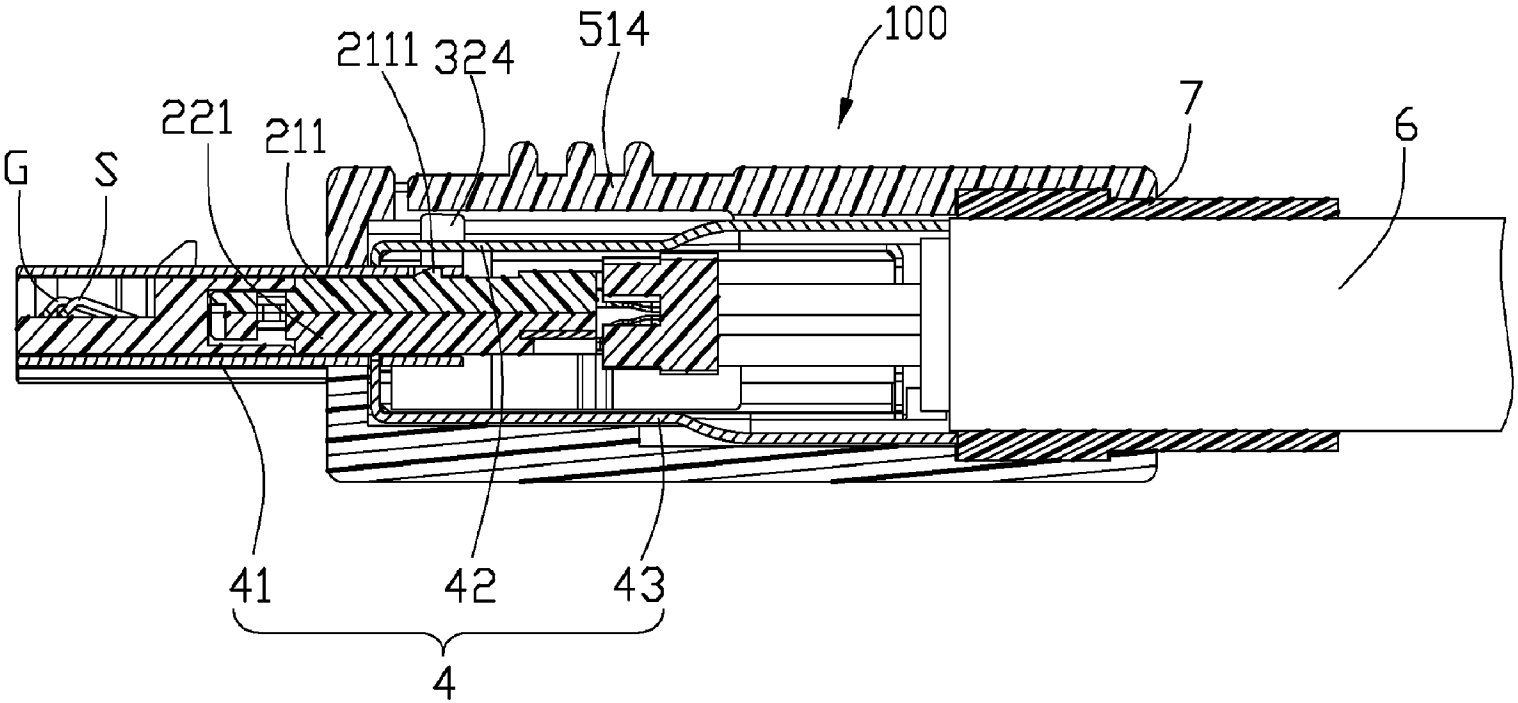
FIG. 6 is a cross-section view taken along line 6-6 of FIG. 4.

The cable assembly 100 is in accordance with DiiVA (Digital Interactive Interface for Video & Audio) standard. Referring to FIG. 1-2, within the cavity 104, along a left-to-right direction, there are thirteen terminals 212, 222 which are arranged in such manner: G-S-S-G-S-S-G-S-S-G-G-S-S. G represents grounding terminal, and S represent signal terminal There are three differential pairs consisted of six signal terminals located between grounding terminals. The differential pairs for high-speed transmitting used for conveying video signals. And a pair of signal terminals disposed in the right side cavity 104 used for audio signals.

When detach the cable assembly 100 from a complementary connector, just press the deformable button 514 to actuate the tab 324 of the latching arm 32, and the latching arm 32 retreat into the slots 101. When the pressing force is withdrawn, the deformable button 514 restored to their original positions, and the latching arms 32 also upwardly movement by rebounded force of the resilient tabs 304.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

What is claimed is:

1. A cable assembly, comprising:

an insulative housing having a main portion and at least one mounting arm extending rearwardly from the main portion, the at least one mounting arm defining a positioning hole;

a plurality of terminals received in the insulative housing, the terminals having contacting portions arranged in a row along transversal direction;

a cable having a plurality of wires connected to the plurality of terminals, respectively;

at least one latching member including a connecting arm, a latching arm and a retention arm, the latching arm and the retention arm spaced apart from each other and extend forwardly from the connecting arm, the retention arm inserted into the positioning hole in the at least one mounting arm, the connecting arm transversally deflected outwardly; and an external cover enclosing the insulative housing and the latching member, the external cover having a deformable button for actuating the latching arm.

2. The cable assembly as recited in claim 1, wherein the latching arm and the retention arm are located in a vertical plane.

3. The cable assembly as recited in claim 2, wherein the connecting arm has a U-shaped body portion located in other vertical plane.

4. The cable assembly as recited in claim 3, wherein the connecting arm further has a first bridge portion and a second bridge portion inwardly extending from the U-shaped body portion.

5. The cable assembly as recited in claim 4, wherein the latching arm and the retention arm are connected to the first bridge portion and the second bridge portion, respectively.

6. The cable assembly as recited in claim 1, wherein there is a tab formed on the latching arm and disposed under the button of the external cover.

7. The cable assembly as recited in claim 1, wherein the terminals are divided into two rows and respectively combined with two insulators to form a first terminal module and a second terminal module.

8. The cable assembly as recited in claim 7, wherein the insulative housing defining a receiving space, and the first terminal module and the second module are inserted into the receiving space.

9. The cable assembly as recited in claim 8, further comprising a metal shell enclosing the insulative housing.

10. The cable assembly as recited in claim 9, wherein the metal shell latching with the first terminal module and the second terminal module.

11. A cable assembly, comprising:

an insulative housing;

a plurality of terminals received in the insulative housing;

a cable having a plurality of wires connected to the plurality of terminals, respectively;

two latching members transversally spaced apart from each other and mounted to the insulative housing, each of the two latching member including a connecting arm, a latching arm and a retention arm, the latching arm and the retention arm extending forwardly from the connecting arm, and transversal distance between the connecting arms larger than transversal distance between the latching arms or transversal distance between the retention arms; and an external cover enclosing the insulative housing and the two latching members, the external cover having a deformable button for actuating the latching arms.

12. The cable assembly as recited in claim 11, wherein the wires are apart from the connecting arms.

13. The cable assembly as recited in claim 11, wherein the insulative housing defines a cavity in a front segment thereof, and contacting portions of the terminals are arranged in a row and accommodated in the cavity.

14. The cable assembly as recited in claim 13, wherein the terminals includes six signal terminals divided into three sets of differential pairs spaced apart from each other by grounding terminals.

15. The cable assembly as recited in claim 13, wherein tail portions of the terminals are separated into two rows along a vertical direction.

16. A cable connector assembly comprising:

an insulative housing defining a mating port with a mating face thereon;

a plurality of grooves formed in the mating face in one row along a transverse direction;

a plurality of first contacts retained by a first insulator with first front contacting sections extending respectively into the corresponding grooves and with first rear soldering sections;

a plurality of second contacts retained in a second insulator with second front contacting sections extending respectively into the corresponding grooves and with second rear soldering sections;

the first insulator and the second insulator being essentially located at different levels defining two different rows in said transverse direction;

the first front contacting sections having first contacting apexes and the second front contacting sections having the second contacting apexes both of which are exposed above the mating face;

said first contacts including first signal contacts and first grounding contacts;

said second contacts including second signal contacts and second grounding contacts; wherein the first front contacting sections of the first contacts and the second front contacting sections of the second contacts are mixed up with each other in said one row along said transverse direction under condition that both the first contacting apexes of the first signal contacts and the second contacting apexes of the second signal contacts are located at essentially a same first position in a front-to-back direction perpendicular to said transverse direction, and both the first contacting apexes of the first grounding contacts and the second contacting apexes of the second grounding contacts are located, in said front-to-back direction, a same second position in front of said same first position.

17. The cable connector assembly as claimed in claim 16, wherein said first insulator and said second insulator are discrete from the housing.

18. The cable connector assembly as claimed in claim 16, wherein said first rear soldering sections and said second rear soldering section are arranged in two rows and directly soldered respectively to corresponding wires behind the housing.

19. The cable connector assembly as claimed in claim 16, wherein the first front contacting sections of the first contacts and the second front contacting sections of the second contacts are arranged alternately along said one row and in the corresponding grooves.

20. The cable connector assembly as claimed in claim 16, wherein a pair of latches are disposed at two opposite sides of the housing, and said pair of latches are actuated by a deformable button which unitarily formed on an insulativer cover enclosing said housing.

* * * * *